US007030344B2

(12) United States Patent
Cho et al.

(10) Patent No.: US 7,030,344 B2
(45) Date of Patent: Apr. 18, 2006

(54) DEFROSTER FOR HEAT EXCHANGER AND FABRICATION METHOD THEREOF

(75) Inventors: Nam-Soo Cho, Seoul (KR); Sung Jhee, Gyeonggi-Do (KR); Jang Seok Lee, Incheon (KR)

(73) Assignee: LG Electronics Inc., Seoul (KR)

( * ) Notice: Subject to any disclaimer, the term of this patent is extended or adjusted under 35 U.S.C. 154(b) by 114 days.

(21) Appl. No.: 10/747,200

(22) Filed: Dec. 30, 2003

(65) Prior Publication Data

US 2004/0200597 A1 Oct. 14, 2004

(30) Foreign Application Priority Data

Apr. 8, 2003 (KR) ..... 10-2003-0022025

(51) Int. Cl.
*H05B 3/06* (2006.01)

(52) U.S. Cl. ..... 219/520; 219/203; 219/522; 219/543; 165/64

(58) Field of Classification Search ..... 165/64, 165/905, 80.3, 80.6; 62/272–275; 219/200–203, 219/522, 543, 547, 520
See application file for complete search history.

(56) References Cited

U.S. PATENT DOCUMENTS

| | | | | |
|---|---|---|---|---|
| 5,354,966 | A * | 10/1994 | Sperbeck | 219/203 |
| 5,475,204 | A * | 12/1995 | Giamati et al. | 219/548 |
| 5,493,102 | A * | 2/1996 | Takase et al. | 219/547 |
| 6,266,969 | B1 | 7/2001 | Malnati et al. | |
| 6,504,392 | B1 * | 1/2003 | Fredeman et al. | 324/760 |

FOREIGN PATENT DOCUMENTS

| | | |
|---|---|---|
| EP | 1 004 835 A2 | 5/2000 |
| EP | 1 120 798 A2 | 8/2001 |
| JP | 4-353373 A | 12/1992 |
| JP | 10-96846 A | 4/1998 |
| WO | WO 03/008880 A1 | 1/2003 |

* cited by examiner

*Primary Examiner*—Tu Hoang
(74) *Attorney, Agent, or Firm*—Birch, Stewart, Kolasch & Birch, LLP

(57) ABSTRACT

A defroster for a heat exchanger includes a heat transfer plate on the heat exchanger; a thin film heater arranged on the heat transfer plate; and a power supply wire connected to the film heater for supplying power to the film heater. The defroster can be fabricated by forming a masking layer with a certain shape on an electrically resistant substrate; patterning a thin film heater on the substrate based on the shape of the masking layer; adhering the film heater to a heat transfer plate; and connecting a power supply to the film heater. Accordingly, it is possible to improve a defrosting performance of the heat exchanger and use an environment-friendly, alternative refrigerant with the relatively, low temperature defroster of the heat exchanger.

26 Claims, 6 Drawing Sheets

DEFROSTER FOR HEAT EXCHANGER AND FABRICATION METHOD THEREOF

CROSS-REFERENCES TO RELATED APPLICATIONS

This nonprovisional application claims priority under 35 U.S.C. § 119(a) on Patent Application No. 22025/2003 filed in Korea on Apr. 8, 2003, the entirety of each of which are herein incorporated by reference.

BACKGROUND OF THE INVENTION

1. Field of the Invention

The present invention relates to a defroster for a heat exchanger and a fabrication method thereof, and more particularly to a defroster for a heat exchanger capable of using an environment-friendly, alternative refrigerant and improving a defrosting performance.

2. Description of the Background Art

In a refrigeration cycle system of the background art, a refrigerant is compressed so as to be in a high temperature-high pressure phase by applying electric energy to a compressor. The compressed, high temperature-high pressure refrigerant is then condensed in a condenser by emitting heat to the outside, and the condensed refrigerant flows into an evaporator through a capillary tube. The evaporator absorbs heat from the outside while the refrigerant is evaporated in the evaporator. In this of refrigeration cycle system, the condenser for emitting heat to the outside or the evaporator for absorbing heat from the outside is referred to as a heat exchanger.

A refrigerator or an air conditioner, etc. preserves food or maintains a temperature of a room in a pleasant state by using a heat exchanger of a refrigeration cycle system. The heat exchanger is often curved so as to have a multiple-shaped refrigerant piping in which a refrigerant flows, and plural heat transfer fins 40 are combined with the curved refrigerant piping in order to increase a heat transfer area. While the refrigerant flows in the refrigerant piping, the heat exchanger exchanges heat with external air through the refrigerant piping and the heat transfer fins 40.

The present inventors have determined that the systems of the background art suffer from the following disadvantages. In the case of a refrigerator or a showcase, etc., a heat exchanger is installed at a side of a food storing space, and a flow of air caused by a fan arranged at a side of the heat exchanger maintains the food storing space in a cold state as it flows or circulates through the heat exchanger. However, during that process, frost caused by moisture in the air forms on the surface of the heat exchanger in the food storing space. The frost will then lower a heat exchange performance of the heat exchanger significantly. Accordingly, a defroster is installed in the system at the heat exchanger in order to periodically remove frost.

FIG. 1 illustrates an example of a defroster of a heat exchanger in accordance with the background art. As depicted in FIG. 1, the heat exchanger includes a plurality of straight pipes 20 installed between two holders 10. In order to connect the straight pipes 20 in a common flow path, each straight pipe 20 is connected by respective curved connection pipes 30. Each of the connection pipes 30 is respectively arranged at both sides of the holders 10. A plurality of heat transfer fins 40 are also combined with the straight pipes 20.

The defroster typically includes a heater 50 installed below the heat transfer fins 40. The heater 50 having a certain length is curved, and both sides of the heater 50 are respectively combined with the holder 10. The heater 50 is installed at an air inlet side of the air flow path in which air flows through the heat exchanger.

The operation of the defroster in the heat exchanger of the background art will be described in greater detail hereinafter. As the heat exchanger is operating, air flows into the heat exchanger by the rotation of a fan (not shown). Heat exchange is performed while the air circulates between the heat transfer fins 40 of the heat exchanger, and the heat-exchanged cold air is discharged out of the heat exchanger. When frost is formed on the heat exchanger as described above, the operation of the heat exchanger is stopped and/or effective heat transfer is significantly reduced. Accordingly, power is supplied to the heater 50, and the heater 50 is heated. Heat generated by the heater 50 is transmitted to the heat exchanger along with the air to remove the frost. Herein, the frost is removed by convection and radiation of the heat generated by the heater.

A defroster having the wire type heater has high stability when experiencing vibration or external impact, great caloric power per unit length, and a surface temperature thereof that is typically very high (not less than 500° C.). However, the wire type defroster can be typically only be used with a non-environment friendly refrigerant. Specifically, when this type of defroster is used with an environment-friendly, alternative refrigerant, ignition risk is very high because of the great caloric power of this type of heater. For example, when using a refrigerant such as a presently used R-134a, ignition risk is low. However, when using an environment-friendly refrigerant such as R600a, etc., ignition risk is very high and the wire type defroster cannot be used.

In addition, since defrosting is performed by heat generated by the heater 50 arranged at a side of the heat exchanger, defrosting is quickly performed only on portions immediately adjacent to the heater 50. Accordingly a lot of time and power consumption are required for defrosting the entire heat exchanger.

SUMMARY OF THE INVENTION

The present invention overcomes the shortcomings associated with the background art and achieves other advantages not realized by the background art.

An object of the present invention is to provide a defroster of a heat exchanger and a fabrication method thereof capable of using an environment-friendly, alternative refrigerant and/or for improving a defrosting performance.

One or more of these and other objects is accomplished by a defroster for a heat exchanger, the defroster comprising a heat transfer plate having a predetermined area for installing on a heat exchanger; a thin film heater being arranged on the heat transfer plate; and a power supply wire being connected to the film heater for supplying power to the film heater.

One or more of these and other objects is also accomplished by a heat exchanger comprising a plurality of pipes; a plurality of fins; and a defroster, the defroster including a heat transfer plate having a predetermined area and being installed on the heat exchanger; a thin film heater being arranged on the heat transfer plate; and a power supply wire being connected to the film heater for supplying power to the film heater.

One or more of these and other objects is also accomplished by a method for fabricating a defroster of a heat exchanger, the method comprising attaching a masking film having a predetermined shape on a substrate made of an electrically resistant material; patterning a film heater on the substrate based on the predetermined shape of the masking film; adhering the film heater to a heat transfer plate having a predetermined area; and connecting a power supply wire to the film heater.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
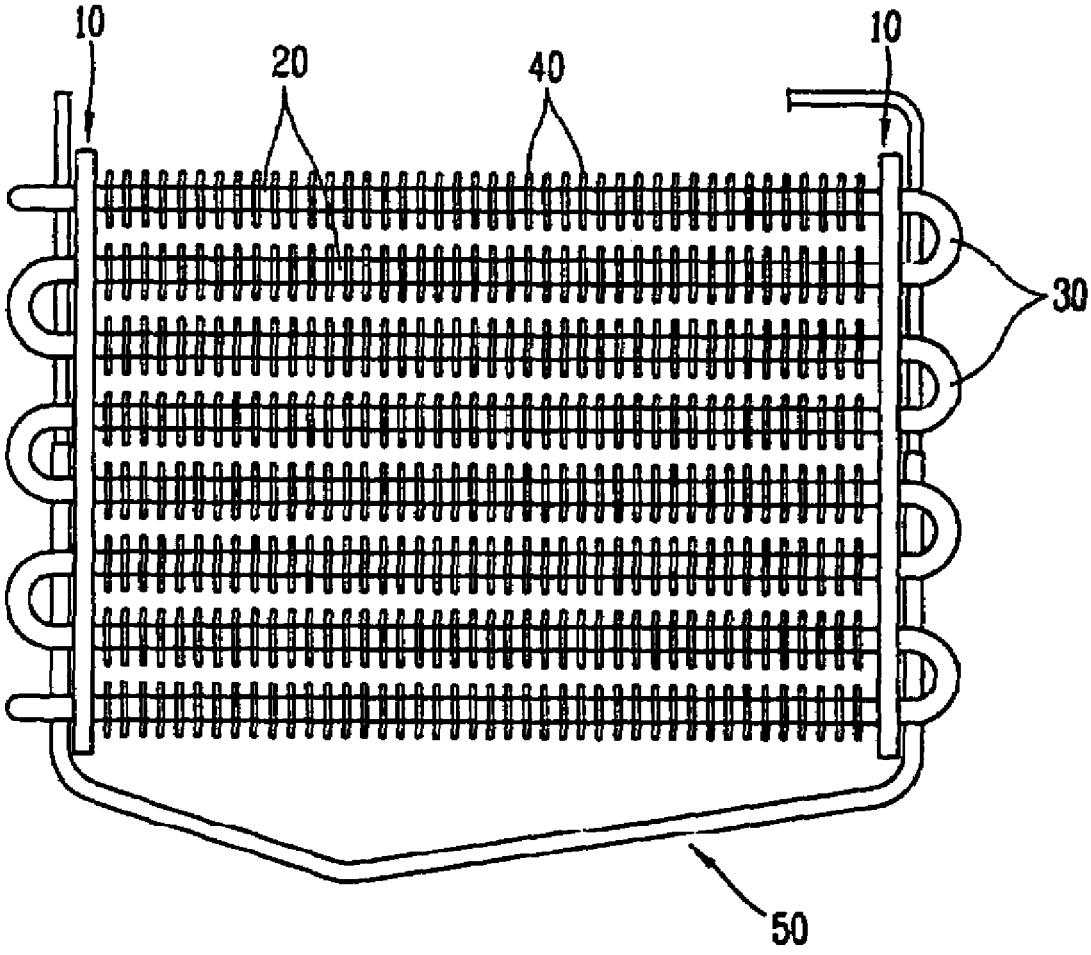
FIG. 1 BACKGROUND ART
FIG. 1 is a front view illustrating a defroster of a heat exchanger in accordance with the background art.
Figure 2:
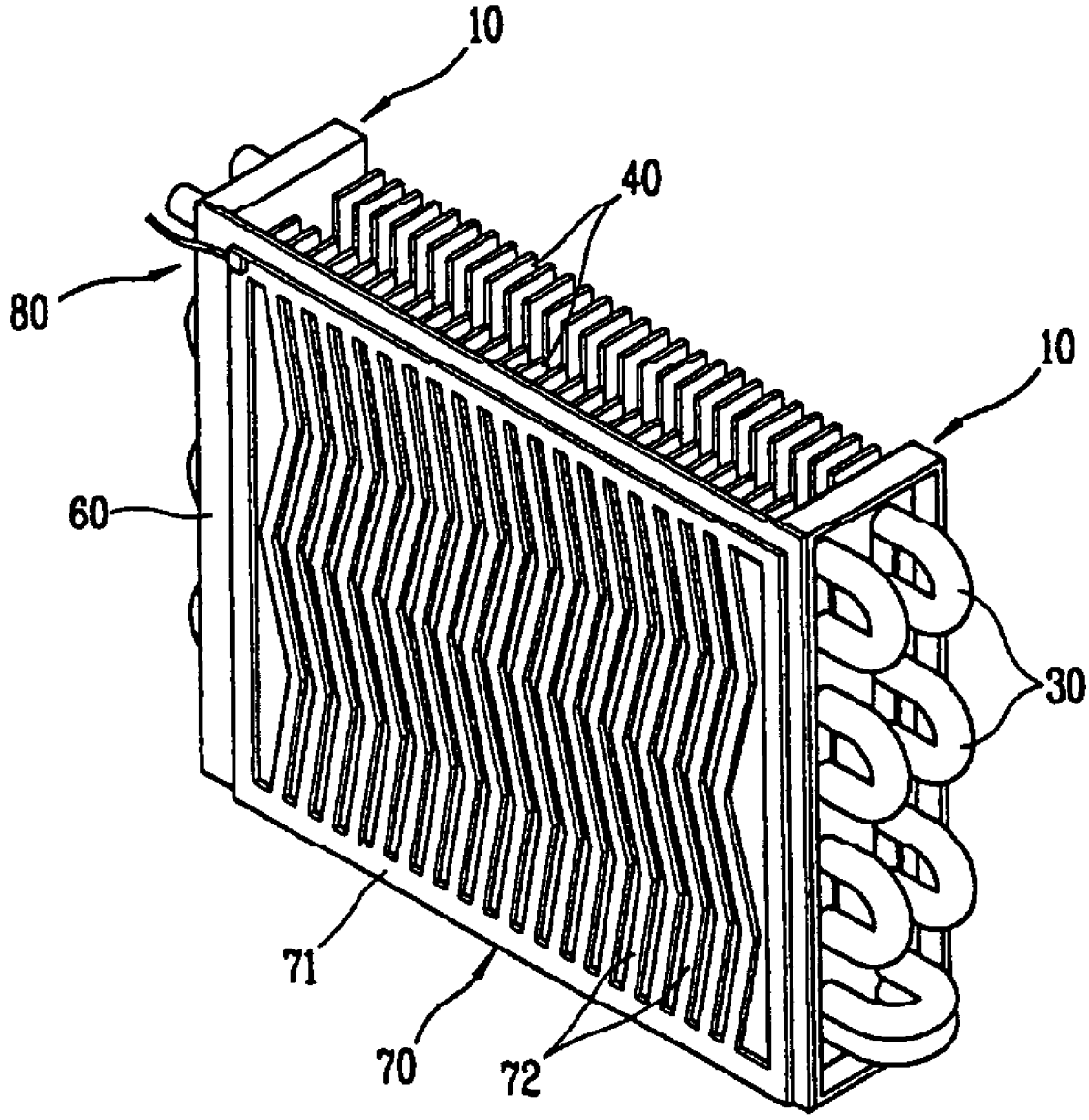
FIG. 2 is a perspective view illustrating a defroster of a heat exchanger in accordance with an embodiment of the present invention.
Figure 3:
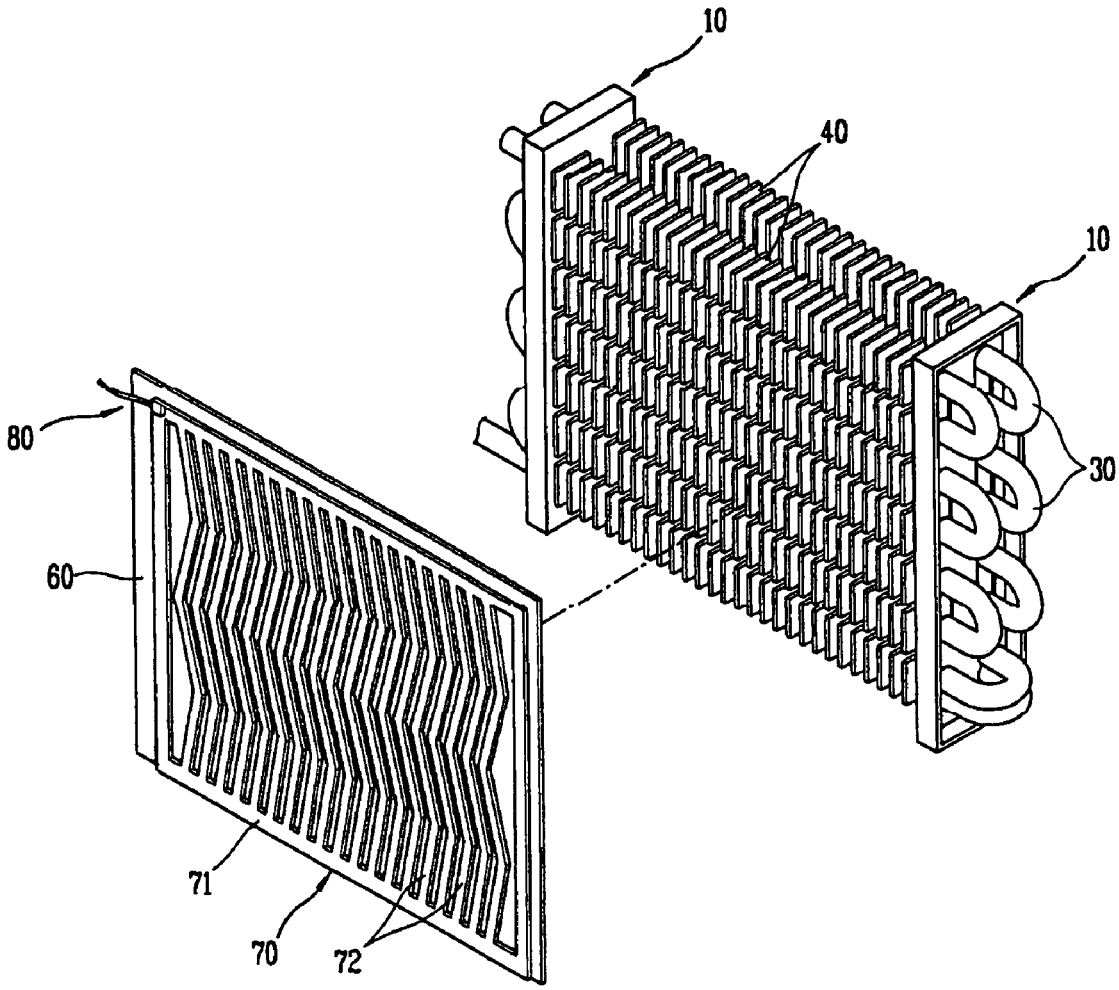
FIG. 3 is an exploded, perspective view illustrating the defroster of the heat exchanger in accordance with an embodiment of the present invention.

The present invention will hereinafter be described with reference to the accompanying drawings. FIG. 2 is a perspective view illustrating a defroster of a heat exchanger in accordance with an embodiment of the present invention. FIG. 3 is an exploded, perspective view illustrating the defroster of the heat exchanger in accordance with an embodiment of the present invention. Common reference numerals have been used to designate common parts in the accompanying drawings.

As depicted in FIGS. 2 and 3, the defroster of the heat exchanger in accordance with the present invention includes a heat transfer plate 60 having a predetermined area, installed on or secured to the heat exchanger; a film heater 70 arranged on the heat transfer plate 60; and a power supply wire 80 connected to the film heater 70 for supplying power to the film heater 70.

The heat exchanger includes two rectangular holders 10 arranged so as to be a certain distance from each other; a plurality of straight pipes 20 joined with each other at regular intervals between the two holders 10; curved connection pipes 30 arranged on the outer surface of the holder 10 in order to connect the straight pipes 20 in one flow path; and a plurality of heat transfer fins 40 combined with the straight pipes 20.

The heat transfer plate 60 is a rectangular sheet formed to correspond to a side surface of the heat exchanger. The heat transfer plate 60 is installed at the heat exchanger so as to be arranged at a side surface of an air flow path in which air flows through the heat exchanger. For example, when air passes through the heat exchanger, the air flows along a direction corresponding to the width of the holder 10 of the heat exchanger, e.g., the heat transfer plate 60 is installed on a side surface of the holder 10 or on a side surface of the heat transfer fins 40. However, the heat transfer plate(s) 60 can be respectively combined with a side or both sides of the holder 10. The heat transfer plate 60 is made of a flexible material that can be easily formed in a curved shape, e.g., the heat transfer plate 60 can be made of a metal or a plastic material.

The film heater 70 is arranged so as to cover the entire surface area of a side of the heat transfer plate 60. The film heater 70 may be constructed as a circuit having a closed-loop shape. For example, the film heater 70 may include a square frame line 71 and a plurality of connection lines 72 being connected at regular intervals with the frame line 71 along the length of the heater 70. The film heater 70 may be projected or formed onto the surface of the heat transfer plate 60. The film heater 70 of a preferred embodiment is made of an electrical resistant material, e.g., aluminum, having a thickness of approximately 20–30 μm. Alternatively, a groove can be formed on the heat transfer plate 60, and the film heater 70 can be inserted into or formed within the groove of the heat transfer plate 60. A power supply wire 80 is then connected to a side of the film heater 70 to power the heater 70.

Figure 4A:
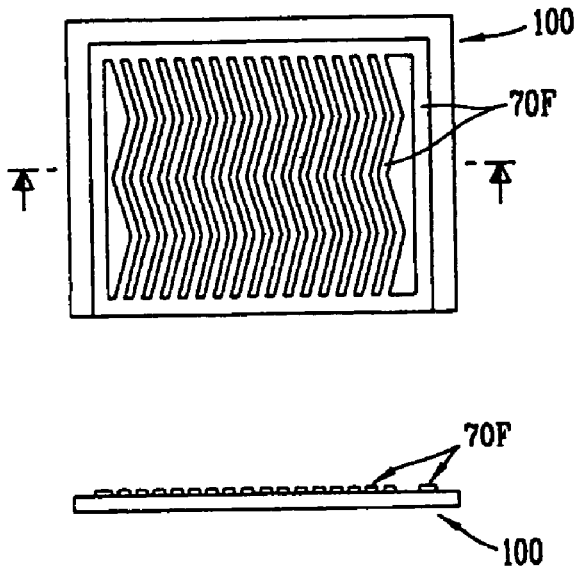
FIG. 4A–4E are plan views sequentially illustrating a method for fabricating a defroster of a heat exchanger in accordance with an embodiment of the present invention.

A method for fabricating the defroster in accordance with an embodiment of the present invention will be described in greater detail hereinafter. FIGS. 4A–4E are plan views sequentially illustrating a method for fabricating a defroster of a heat exchanger in accordance with the present invention. As shown in FIG. 4A, a substrate 100 having an electrically resistant body is fabricated. Masking is then performed on the substrate 100 in a predetermined shape, e.g., in the shape of the film heater 70. For example, a masking film 70F having the shape of the film heater 70 is adhered to the substrate 100 during the masking process. The substrate 100 can be made of several materials, e.g., preferably aluminum, and formed having a thickness of approximately 20–30 μm.

Figure 4B:
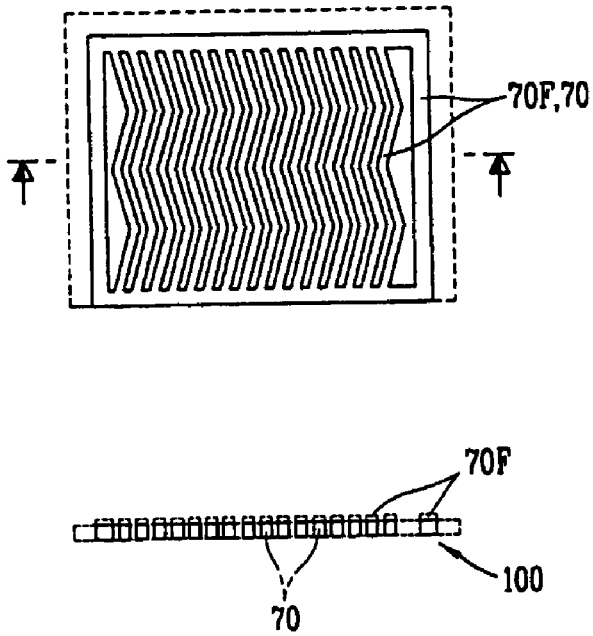
Figure 4C:
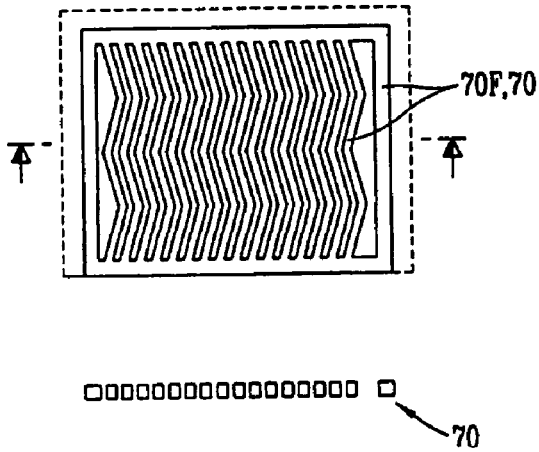

As shown in FIGS. 4B and 4C, by etching the masking film 70F adhered to the substrate 100, the remaining portions that have not been masked can be removed. For example, a strong, acidic solution is used in the etching process. After the etching process, the portions remaining (of the substrate) form the film heater 70.

Figure 4D:
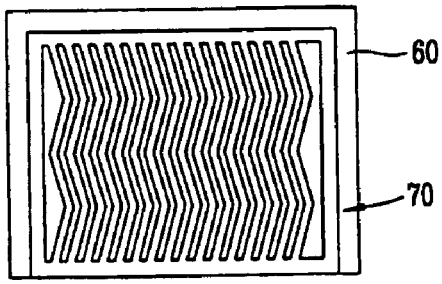

As shown in FIG. 4D, the film heater 70 is arranged on the heat transfer plate 60. The heat transfer plate 60 is a flexible, rectangular sheet formed in a predetermined shape to correspond to a side surface of the heat exchanger. As descried hereinabove, the heat transfer plate 60 can be made of a metal or a plastic material.

Figure 4E:
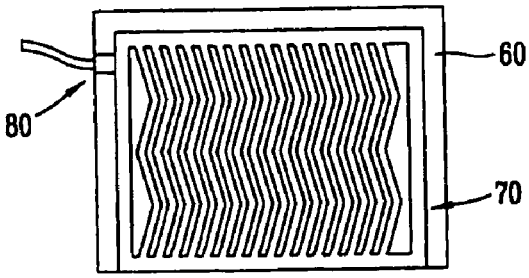

As shown in FIG. 4E, the power supply wire 80 is connected the heater 70, e.g., preferably to a side of the film heater 70.

The fabricated defroster is then installed on the heat exchanger. The defroster is arranged on a side surface of the heat exchanger so as to be at one side of an air flow path in which air flows through the heat exchanger.

Several advantages of the defroster and the fabrication method thereof in accordance with the present invention will be described in greater detail hereinafter.

First, the heat exchanger is installed on a side of a food storing space in a refrigerator or a showcase, etc., and the defroster in accordance with the present invention is installed on a side of the heat exchanger. A fan installed at a side of the heat exchanger is operated simultaneously with the heat exchanger to produce an air flow for maintaining the food storing space in a cold state while circulating through the heat exchanger. Due to moisture in the food storing space, frost is formed on the surface of the heat exchanger. Power is then supplied to the power supply wire 80 of the defroster when frost is sensed or detected.

When power is applied to the power supply wire 80, the film heater 70 is heated and generates heat, the heat is transmitted to the heat exchanger through the heat transfer plate 60, and the frost formed on the heat transfer fin 40 of the heat exchanger is removed. The film heater 70 will typically have a surface temperature not greater than 50° C. Heat from the heater 70 is transmitted to the entire heat exchanger through the heat transfer plate 60 for melting any frost.

In the present invention, defrosting is performed by simultaneously transmitting heat along the entire area of the heat exchanger so that defrosting is accomplished quickly. In addition, by forming the thin film heater 70 arranged on the heat transfer plate 60, caloric power per unit length of the film heater 70 is relatively low and accordingly ignition risk is low.

Figure 5:
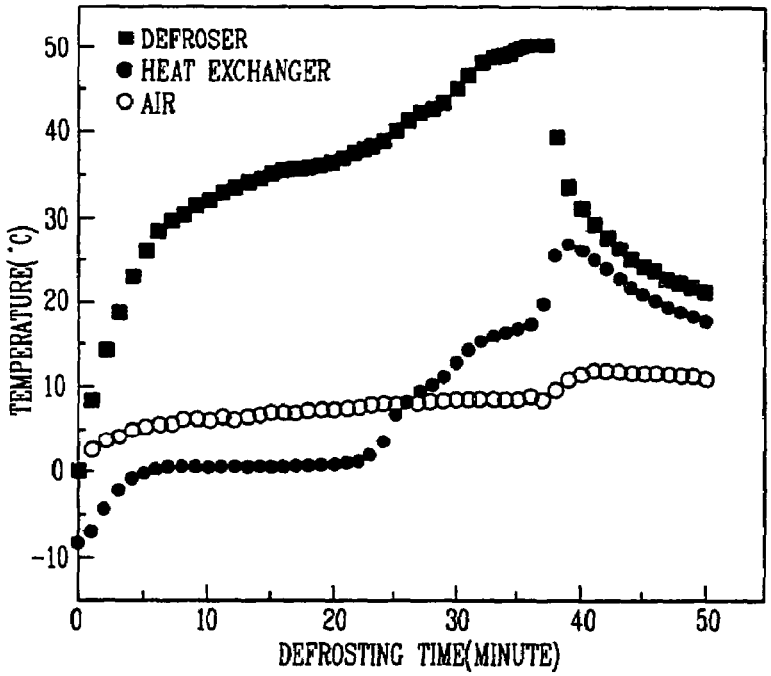
FIG. 5 is a graphical view showing a temperature state according to a defrosting time of the defroster of the heat exchanger in accordance with the present invention.

FIG. 5 is a graphical view showing a temperature state according to a defrosting time of the defroster of the heat exchanger in accordance with the present invention. As shown in FIG. 5, after a defrosting period has passed, the temperature of the defroster does not exceed 50° C. Since a temperature of the heat transmitted to the heat exchanger is maintained above 20° C., heat transfer is performed efficiently. In addition, since the temperature of the air surrounding the portion heated by the defroster does not exceed 10° C., the temperature of the food storing space is not effected.

Figure 6:
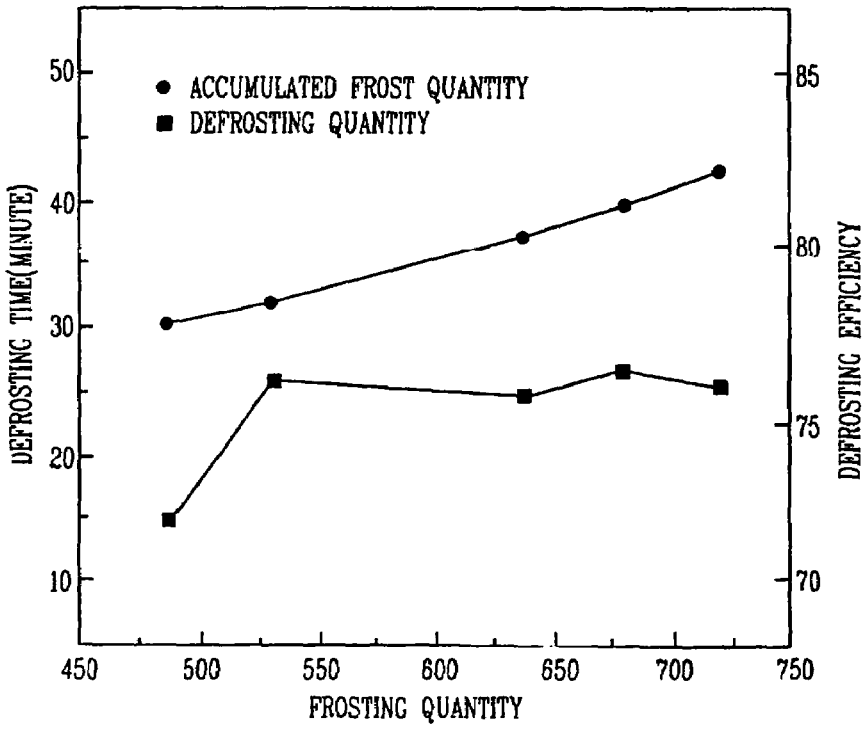
FIG. 6 is a graphical view showing a frosting quantity and a defrosting quantity according to a defrosting time of the defroster of the heat exchanger in accordance with the present invention.

FIG. 6 is a graphical view showing a frosting quantity and a defrosting quantity according to a defrosting time of the defroster of the heat exchanger in accordance with the present invention. As depicted in FIG. 6, with the passage of time, a frosting quantity is reduced, and defrosting is performed smoothly.

As described-above, in the defroster of the heat exchanger and the fabrication method thereof in accordance with the present invention, defrosting is performed along the whole area of the heat exchanger, a defrosting time is reduced, power consumption is lowered, and efficiency of the defroster is improved. In addition, the defroster has a low caloric power per unit length that significantly reduces the risk of ignition. Accordingly this defroster can be used safely together with an environment-friendly alternative refrigerant.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A defroster for a heat exchanger, said defroster comprising:

a heat transfer plate having a predetermined area for installing on a heat exchanger;

a thin film heater being arranged on the heat transfer plate; and a power supply wire being connected to the film heater for supplying power to the film heater, wherein the thin film heater includes a frame and a plurality of connection lines connected at regular intervals with the frame along a length of the thin film heater.

2. The defroster according to claim 1, wherein the heat transfer plate is made of a flexible material.

3. The defroster according to claim 1, wherein the heat transfer plate is made of a metal material.

4. The defroster according to claim 1, wherein the heat transfer plate is made of a plastic material.

5. The defroster according to claim 1, wherein the thin film heater is arranged so as to cover an entire area of a side of the heat transfer plate.

6. A defroster for a heat exchanger, said defroster comprising:

a heat transfer plate having a predetermined area for installing on a heat exchanger;

a thin film heater being arranged on the heat transfer plate; and a power supply wire being connected to the film heater for supplying power to the film heater, wherein the thin film heater protrudes from a surface of the heat transfer plate.

7. A defroster for a heat exchanger, said defroster comprising:

a heat transfer plate having a predetermined area for installing on a heat exchanger;

a thin film heater being arranged on the heat transfer plate; and a power supply wire being connected to the film heater for supplying power to the film heater, wherein the thin film heater is arranged on the heat transfer plate and is inserted into a groove formed on a surface of the heat transfer plate.

8. A defroster for a heat exchanger, said defroster comprising:

a heat transfer plate having a predetermined area for installing on a heat exchanger;

a thin film heater being arranged on the heat transfer plate; and a power supply wire being connected to the film heater for supplying power to the film heater, wherein the thin film heater is made of aluminum and has a thickness of approximately 20–30 μm.

9. A heat exchanger comprising:

a plurality of pipes;

a plurality of fins; and a defroster, said defroster including a heat transfer plate having a predetermined area and being installed on the heat exchanger;

a thin film heater being arranged on the heat transfer plate; and a power supply wire being connected to the film heater for supplying power to the film heater, wherein the thin film heater includes a frame and a plurality of connection lines connected at regular intervals with the frame along a length of the thin film heater.

10. The heat exchanger according to claim 9, wherein the heat transfer plate is positioned at a first side of an air flow path in which air flows through the heat exchanger.

11. The heat exchanger according to claim 9, wherein the heat transfer plate is made of a flexible material.

12. The heat exchanger according to claim 9, wherein the heat transfer plate is made of a metal material.

13. The heat exchanger according to claim 9, wherein the heat transfer plate is made of a plastic material.

14. The heat exchanger according to claim 9, wherein the thin film heater is arranged so as to cover an entire area of a side of the heat transfer plate.

15. A heat exchanger comprising:

a plurality of pipes;

a plurality of fins; and a defroster, said defroster including a heat transfer plate having a predetermined area and being installed on the heat exchanger;

a thin film heater being arranged on the heat transfer plate; and a power supply wire being connected to the film heater for supplying power to the film heater, wherein the thin film heater protrudes from a surface of the heat transfer plate.

16. A heat exchanger comprising:

a plurality of pipes;

a plurality of fins; and a defroster, said defroster including a heat transfer plate having a predetermined area and being installed on the heat exchanger;

a thin film heater being arranged on the heat transfer plate; and a power supply wire being connected to the film heater for supplying power to the film heater, wherein the thin film heater is arranged on the heat transfer plate and is inserted into a groove formed on a surface of the heat transfer plate.

17. A heat exchanger comprising:

a plurality of pipes;

a plurality of fins; and a defroster, said defroster including a heat transfer plate having a predetermined area and being installed on the heat exchanger;

a thin film heater being arranged on the heat transfer plate; and a power supply wire being connected to the film heater for supplying power to the film heater, wherein the thin film heater is made of aluminum and has a thickness of approximately 20–30 μm.

18. A method for fabricating a defroster of a heat exchanger, said method comprising:

attaching a masking film having a predetermined shape on a substrate made of an electrically resistant material;

patterning a film heater on the substrate based on the predetermined shape of the masking film;

adhering the film heater to a heat transfer plate having a predetermined area; and connecting a power supply wire to the film heater, wherein the film heater includes a frame and a plurality of connection lines connected at regular intervals with the frame along a length of the film heater.

19. The method according to claim 18, wherein the substrate is made of aluminum.

20. A method for fabricating a defroster of a heat exchanger, said method comprising:

attaching a masking film having a predetermined shape on a substrate made of an electrically resistant material;

patterning a film heater on the substrate based on the predetermined shape of the masking film;

adhering the film heater to a heat transfer plate having a predetermined area; and connecting a power supply wire to the film heater, wherein thickness of the substrate is 20–30 μm.

21. The defroster according to claim 1, wherein the frame comprises a square shape.

22. The defroster according to claim 1, where the plurality of connection lines comprises a zigzag shape with protrusions protruding away from the frame.

23. The heat exchanger according to claim 9, wherein the frame comprises a square shape.

24. The heat exchanger according to claim 9, where the plurality of connection lines comprises a zigzag shape with protrusions protruding away from the frame.

25. The method according to claim 18, wherein the frame comprises a square shape.

26. The method according to claim 18, where the plurality of connection lines comprises a zigzag shape with protrusions protruding away from the frame.

* * * * *